US010260269B2

(12) United States Patent
Weißenburger

(10) Patent No.: US 10,260,269 B2
(45) Date of Patent: Apr. 16, 2019

(54) WATER-CONDUCTING DOMESTIC APPLIANCE AND METHOD FOR OPERATING A WATER-CONDUCTING DOMESTIC APPLIANCE

(71) Applicant: BSH Hausgeräte GmbH, Munich (DE)

(72) Inventor: Martin Weißenburger, Bissingen (DE)

(73) Assignee: BSH Hausgeräte GmbH, Munich (DE)

( * ) Notice: Subject to any disclaimer, the term of this patent is extended or adjusted under 35 U.S.C. 154(b) by 262 days.

(21) Appl. No.: 15/345,696

(22) Filed: Nov. 8, 2016

(65) Prior Publication Data

US 2017/0138109 A1 May 18, 2017

(30) Foreign Application Priority Data

Nov. 16, 2015 (DE) ..... 10 2015 222 580

(51) Int. Cl.
*A47L 15/00* (2006.01)
*A47L 15/42* (2006.01)
(Continued)

(52) U.S. Cl.
CPC ..... *E05F 15/40* (2015.01); *A47L 15/0049* (2013.01); *A47L 15/4257* (2013.01); *E05F 15/70* (2015.01); *G08B 21/22* (2013.01); *A47L 15/4261* (2013.01); *A47L 2401/20* (2013.01); *A47L 2401/24* (2013.01); *A47L 2401/30* (2013.01); *A47L 2401/32* (2013.01);
(Continued)

(58) Field of Classification Search
CPC ..... A47L 15/0049; A47L 15/4257; A47L 15/4261; A47L 2401/20; A47L 2401/24; A47L 2401/30; A47L 2401/32; A47L 2401/34; A47L 2501/05; A47L 2501/22; A47L 2501/26; E05F 15/40; E05F 15/70; E05Y 2400/44; E05Y 2400/45; E05Y 2400/52; E05Y 2900/304; G08B 21/22
USPC ..... 134/56 D, 57 D, 57 DL, 58 D, 113
See application file for complete search history.

(56) References Cited

U.S. PATENT DOCUMENTS 6,675,818 B1 * 1/2004 Schrott ..... A47L 15/0049 134/57 D
2013/0232877 A1 9/2013 Tiekoetter
(Continued)

FOREIGN PATENT DOCUMENTS

DE 4020898 A1 1/1992
DE 102009003120 A1 11/2010
(Continued)

OTHER PUBLICATIONS

Report of Examination DE 10 2015 222 580.1 dated Jul. 22, 2016.
European Search Report EP 16 19 4892 dated Feb. 9, 2017.

*Primary Examiner* — Levon J Shahinian
(74) *Attorney, Agent, or Firm* — Michael E. Tschupp; Andre Pallapies; Brandon G. Braun

(57) ABSTRACT

A water-conducting domestic appliance includes a washing container, a door which is pivotably mounted to the washing container to define with the washing container a washing chamber for washing items, and a door opening module configured to automatically open the door. A detector detects a presence of a living being in a defined area in front of the domestic appliance. In the event the presence of a living being has been detected by the detector in the defined area, a control device prevents the door opening module from automatically opening the door.

16 Claims, 7 Drawing Sheets

(51) Int. Cl.
*E05F 15/40* (2015.01)
*E05F 15/70* (2015.01)
*G08B 21/22* (2006.01)

(52) U.S. Cl.
CPC ..... *A47L 2401/34* (2013.01); *A47L 2501/05* (2013.01); *A47L 2501/22* (2013.01); *A47L 2501/26* (2013.01); *E05Y 2400/44* (2013.01); *E05Y 2400/45* (2013.01); *E05Y 2400/52* (2013.01); *E05Y 2900/304* (2013.01)

(56) References Cited

U.S. PATENT DOCUMENTS

| | | | |
|---|---|---|---|
| 2015/0019017 | A1 | 1/2015 | Bodine et al. |
| 2015/0157184 | A1 | 6/2015 | Alexander |

FOREIGN PATENT DOCUMENTS

| | | | |
|---|---|---|---|
| DE | 102011050914 | A1 | 12/2012 |
| WO | 2013167490 | A2 | 11/2013 |

* cited by examiner

WATER-CONDUCTING DOMESTIC APPLIANCE AND METHOD FOR OPERATING A WATER-CONDUCTING DOMESTIC APPLIANCE

BACKGROUND OF THE INVENTION

The present invention relates to a water-conducting domestic appliance, such as a dishwasher, for example, as well as to a method for operating a water-conducting domestic appliance.

It is a matter of interest to users of dishwashers that the items to be washed be in as dry a state as possible following termination of the washing process so that they can be immediately removed from the dishwasher and put away. For this reason conventional dishwashers provide, as the final stage of the wash program, a drying step in which the dishes are able to drain and dry. How effective this drying process is, depends to a considerable extent on the ventilation of the washing compartment. A door opening assistant or door opening module may therefore be provided in conventional dishwashers. Such a door opening module is described for example in DE 10 2012 207 836 A1.

When suitably actuated by a control unit, said door opening module opens the door automatically. For the advantageous drying process it is sufficient to open the door by a slight amount to create a small gap. In this case the lock of the door is released and the opening of the door is stopped by way of a spring-cable system as soon as the desired gap size has been reached. It may, however, happen that e.g. a broken cable is present, which would lead to the door dropping open in an uncontrolled manner. Since doors of dishwashers may have a considerable weight, there therefore exists a hazard potential for living beings present in the vicinity. The door opening assistant must therefore be provided with safeguards against malfunction for safety reasons.

DE 10 2011 050 914 A1 discloses a cable break sensor. In this case, should a malfunction be detected, the entire door opening assistant is overridden. The door therefore remains closed in this case and no means of assisting the drying of the washed items is provided. To restore the function, the dishwasher must then be inspected by a qualified person and the defective parts must be replaced, which may result in high costs.

BRIEF SUMMARY OF THE INVENTION

Against this background, an object of the present invention is to provide an improved water-conducting domestic appliance.

According to one aspect of the present invention, a water-conducting domestic appliance includes a washing container, a door pivotably mounted to the washing container to define with the washing container a washing chamber for washing items, a detector configured to detect a presence of a living being in a defined area in front of the domestic appliance, a door opening module configured to automatically open the door, and a control device configured to inhibit automatic opening of the door by the door opening module in response to the detection of a living being in the defined area.

Advantageously, this enables an opening of the door that is not desired by the user of the domestic appliance, for example an automatic opening of the door, to be prevented when a presence of a living being is detected in the defined area by means of the detector. The defined area is in particular produced by the movement radius of the pivotably mounted door of the domestic appliance.

In particular, the control device can be configured to prevent or inhibit the opening of the door in the event of an absence of a door opening request actuated by a user and a detected presence of a living being in the defined area. For example, the door opening request by the user may be actuated by touching a predetermined sensor on the control panel of the domestic appliance.

The water-conducting domestic appliance can be a dishwasher.

This affords the advantage that the door will not open automatically when a hazard potential for a living being is detected. This ensures, regardless of the function of the door opening module, that no living being will come to harm as a result of the door opening.

According to a further embodiment, the detector can be configured to detect the presence of a living being in a movement radius of the pivotably mounted door.

In this way it can be ensured that in the event of an imminent risk to a living being posed by the door of the water-conducting domestic appliance when the living being is located within the movement radius of the door, the latter remains closed.

According to a further embodiment, the detector can include a motion sensor, an infrared motion sensor, an HF sensor, an ultrasound sensor, a Doppler radar sensor and/or an image recognition device.

The advantageous variant may be selected according to requirements in terms of the size, the positioning and/or the costs of the detector. In particular, an image recognition device offers the additional possibility of identifying a person in the room and executing further control functions as a function thereof. Furthermore, not just the presence of a living being may be detected by means of an image recognition device, but where applicable also another object that is present within the movement radius of the pivotably mounted door. This may be e.g. a stool or the like. In that case the automatic opening of the door can likewise be prevented in order to avert damage to the object as well as to the door of the domestic appliance.

According to a further embodiment, the control device can be configured to prevent the opening of the door for a specific period of time as a function of a detected presence of a living being in the defined area.

This advantageously enables the door of the domestic appliance to be opened only once the specific period of time has elapsed and there is a correspondingly high probability that the living is no longer exposed to the hazard potential. The specific period of time lies for example between five and twenty seconds.

According to a further embodiment, the control device can be configured to perform a further check after the specific period of time has elapsed in order to determine whether the detector has detected a living being in the defined area after the specific period of time has elapsed, and as a function thereof once again to prevent the opening of the door and/or to execute an alternative control function.

The detector is in this case configured in such a way that it performs the measurement autonomously and provides the result to the control device, or that upon being actuated by the control device it performs a measurement and outputs the result to the control device. This advantageously enables the detector to be activated for short measurement intervals only, thereby enabling power to be saved. Should a hazard potential for the living being continue to be present after the specific period of time has elapsed, the opening of the door can once again be prevented or another control function, e.g. the output of an acoustic signal, can be executed. This iterative loop may be repeated as often as necessary until the hazard potential no longer exists. Alternatively, a different preset control signal may also be emitted after a predetermined number of specific periods of time have elapsed, and the iterative loop can be interrupted.

This different control signal may be e.g. an acoustic signal in order to notify a user that an automatic opening of the door will no longer take place in the current program or that another user input is required. The signal may also be a status message of the domestic appliance that is output via a user interface, e.g. a display disposed on the appliance. A user interface may in particular comprise input and output means. It may also concern a further function of the domestic appliance, e.g. a rinse cycle at high water temperature, which advantageously promotes the drying of washed dishware items even when the door is closed.

According to a further embodiment, the detector can be mounted on the door, integrated in a door leaf of the door, arranged in a plinth of the domestic appliance, or integrated in a control panel of the door.

This enables the detector, while maintaining its function, to be employed both in freestanding and in semi-integrated or fully integrated dishwashers, or a plurality of detectors may be used at different positions, each having different detection zones and/or detection characteristics. The use of a plurality of detectors may be advantageous when initially only a first detector, e.g. a motion sensor, is permanently active. As soon as said sensor detects a movement in a defined area, a second detector, e.g. an image recognition unit, can be activated. This advantageously removes the need for complex and energy-intensive detectors to be in a permanently activated state, thereby enabling power to be saved.

According to a further embodiment, the control device can be configured to generate a control signal for actuating at least one specific unit as a function of a detected presence of a living being in the defined area.

As a result of the detection signal generated as a function of the detected presence of a living being, the control device is able to actuate different units of the domestic appliance, such as, for example, a lighting device or a user interface, and consequently improve the control functionalities of the domestic appliance.

This enables a user that is present to be alerted to an event in different ways, while at the same time it is verified that the user is located in the vicinity of the domestic appliance and is therefore able to take notice of the alert.

According to a further embodiment, the at least one specific unit can be embodied by means of a lighting device for illuminating the washing container, a projection device for projecting a remaining operating time of the domestic appliance, a display lighting of a display of the domestic appliance, an output device for outputting at least one acoustic signal, a web-based application function, a further user interface, and/or an actuation device for activating a pump of the domestic appliance.

This enables a user that is present to be alerted by output of an acoustic signal by means of the output device to the end of the washing process or to the remaining time of the washing process by displaying the time remaining on the display. Furthermore, power can be saved by e.g. actuating the display lighting, the display and/or the lighting device for illuminating the washing container only when the user is located in the vicinity of the domestic appliance. The actuation device for activating the pump can also actuate the pump of the dishwasher in such a way that the latter operates more quietly while the user is present in the vicinity, thereby achieving a reduction in noise nuisance. Status information may be output to a mobile device of the user by way of a web-based application function when the user approaches the domestic appliance. Said status information may comprise e.g. current values relating to the washing process, such as start time, end time, time remaining, water temperature, or current wash cycle. However, other appliance or maintenance information may also be output, e.g. number of washing processes, fill level of the rinse aid container or of the water-softening salt container, water consumption, energy consumption, etc. The information may be transmitted e.g. via RFID, Bluetooth, WLAN or other, advantageously wireless, transmission systems. In particular, all of the information acquired by the domestic appliance may be passed on to the user.

According to a further embodiment, the detector can be embodied as an HF sensor which is configured to detect a blockage of a spray arm in the washing container.

In this embodiment, the detector represents a dual function. On the one hand it is configured to detect the presence of a living being in the defined area in front of the domestic appliance, and on the other hand it is configured to detect a blockage of a spray arm or a plurality of spray arms. This advantageously enables a more cost-effective and simpler design of the domestic appliance in comparison with one in which dedicated detectors are employed for each of said functions.

According to a further embodiment, the control device can be configured to activate a user interface as a function of a blockage of the spray arm detected by the HF sensor in such a way that said user interface outputs a user output in order to warn the user.

In this way the user can advantageously be provided with information to the effect that an object may be blocking a spray arm, or that a fault, e.g. a clogged nozzle or hydraulic line or a worn bearing, is present. The user may then firstly establish the cause of the blockage without a qualified person and if necessary rectify the same, or alternatively seek the advice of a qualified person.

According to a further embodiment, the detector can be configured to provide a plurality of detection signals as a function of the presence of a living being in a corresponding plurality of different detection zones of the domestic appliance.

The plurality of different detection zones may comprise e.g. a subdivision into three areas: a first remote zone, in which a presence of a living being causes a general function, such as e.g. the output of an acoustic signal or further functions, as already explained hereinabove, to be initiated, wherein the first remote zone comprises for example an area at a distance of 50-1000 cm from the detector, a second zone, which comprises e.g. the movement radius of the door, in which an automatic opening of the door is prevented due to the presence of a living being, and a third zone, which is e.g. an area close to the detector in which user gestures can be recognized to allow gesture control of the domestic appliance. The area close to the detector in this case comprises e.g. an area at a distance of 0-10 cm from the detector. Depending on the user gesture, further control functions may then be triggered, e.g. automatic full opening of the door, extension or retraction of the dish racks (in the open state), a lower rack lifting function, an automatic closing of the door, a reduction in the operating noise by corresponding measures, etc.

According to a further embodiment, the detector can be configured to provide a first detection signal if the presence of a living being is detected in a remote zone of the domestic appliance and to provide a second detection signal if the presence of a living being is detected in a near zone of the domestic appliance.

According to a further embodiment, the control device can be configured to prevent the opening of the door as a function of at least one of the plurality of the provided detection signals and to actuate the door opening module as a function of at least one other of the plurality of the provided detection signals in such a way that said signal automatically opens the door. A differentiated operation of the door opening module is achieved in this way.

According to a further embodiment, the control device can be configured to perform a number of wash programs for washing items to be washed.

In particular, a wash program comprises one or more of the following phases: prewash, cleaning cycle, mid-cycle rinse, final rinse, and/or drying cycle. With different wash programs, the phases may be embodied differently.

According to a further embodiment, the domestic appliance can be a dishwasher, a washing machine, a dryer, in particular a tumble dryer, or a steamer.

According to another aspect of the present invention, a method for operating a water-conducting domestic appliance, in particular a dishwasher includes detecting a presence of a living being in a defined area in front of the domestic appliance, and inhibiting automatic opening of a door of the domestic appliance in response to a detection of a living being in the defined area.

According to still another aspect of the present invention, a computer program is embodied in a non-transitory computer readable medium, wherein the computer program, when loaded into a processing device and executed by the processing device, causes the processing device to perform a method for operating a water-conducting domestic appliance, the method including detecting a presence of a living being in a defined area in front of the domestic appliance; and inhibiting automatic opening of a door of the domestic appliance in response to a detection of a living being in the defined area.

A computer program product, such as e.g. a computer program means, may be provided or supplied as, for example, a storage medium, such as e.g. memory card, USB stick, CD-ROM, DVD, or also in the form of a file that may be downloaded from a server in a network. This can be realized for example in a wireless communications network by the transfer of a corresponding file containing the computer program product or the computer program means.

The embodiments and features described with regard to the proposed water-conducting domestic appliance apply analogously to the proposed method.

Further possible implementations of the invention also comprise not explicitly cited combinations of features or embodiments described hereintofore or hereinafter in relation to the exemplary embodiments. In this case the person skilled in the art will also add individual aspects as improvements or enhancements to the respective basic form of the invention.

BRIEF DESCRIPTION OF THE DRAWINGS

Further advantageous embodiments and aspects of the invention are the subject matter of the dependent claims as well as of the below-described exemplary embodiments of the invention. The invention is explained in more detail hereinbelow with the aid of preferred embodiments and with reference to the attached figures, in which:

DETAILED DESCRIPTION OF EXEMPLARY EMBODIMENTS OF THE PRESENT INVENTION

Unless specified otherwise, like or functionally identical elements have been labeled with the same reference signs in the figures.

Figure 1:
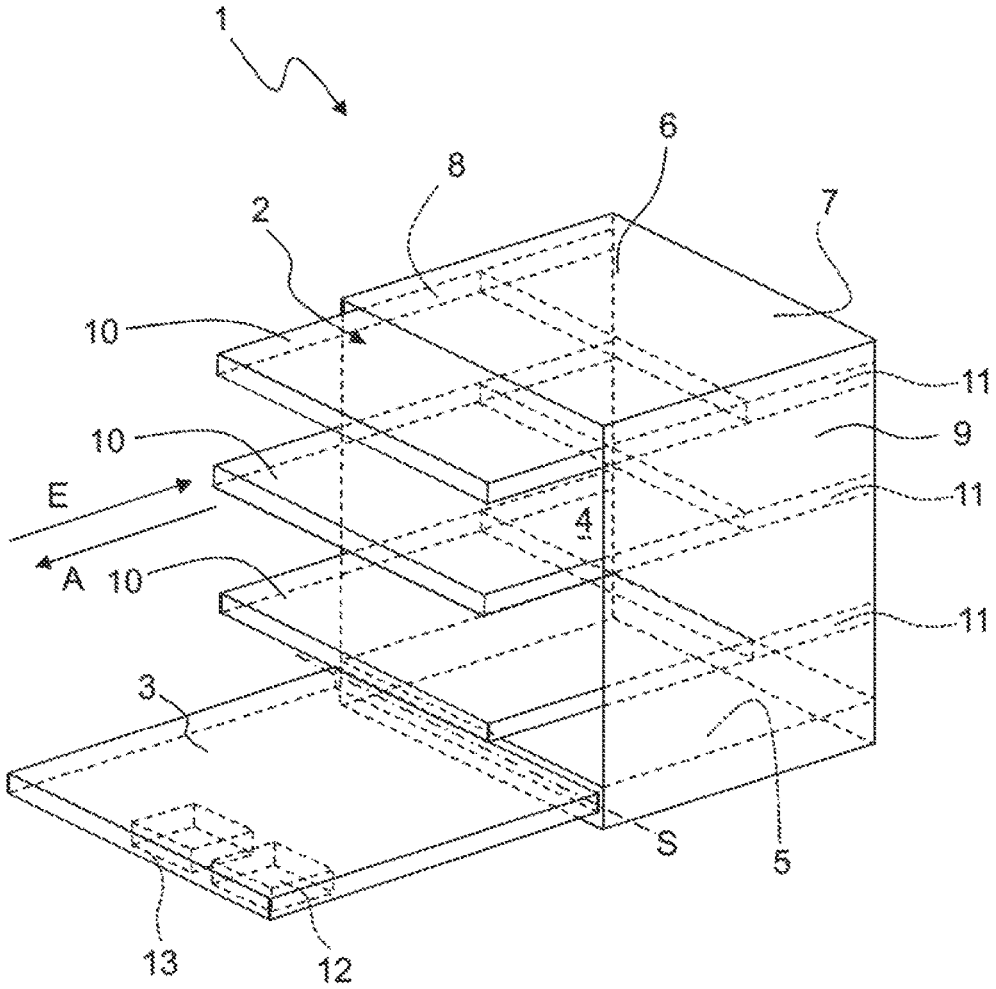
FIG. 1 shows a perspective view of a first embodiment of a water-conducting domestic appliance.

FIG. 1 shows a perspective view of a first embodiment of a water-conducting domestic appliance 1. In the example shown in FIG. 1, the water-conducting domestic appliance 1 is a dishwasher.

The dishwasher 1 has a body encompassing a washing container 2, and a door 3. The washing container 2 and the door 3 form a washing chamber 4 for washing dishware items to be washed. In FIG. 1, the door 3 is shown in its open position. The door 3 can be closed or opened by being pivoted about an axis of rotation S provided at a lower end of the door 3.

The washing container 2 is for example cuboid in shape and may comprise a base 5, a top 6 disposed opposite the base 5, a back wall 7 disposed opposite the door 3, and two side walls 8, 9 disposed opposite each other. In particular the side walls 8, 9 may be manufactured from stainless steel sheet.

The dishwasher 1 additionally has at least one loading level 10. The at least one loading level 10 is preferably a holder for items to be washed of the dishwasher 1. In particular, a plurality of loading levels 10 can be provided, which may comprise a lower rack, an upper rack and/or a cutlery drawer. The plurality of loading levels 10 are preferably arranged one above the other in the washing container 2. Each loading level 10 can be moved selectively into the washing container 2 in an insertion direction E or out of said washing container 2 in a withdrawal direction A. For this purpose a rail 11 is preferably provided on both sides of a respective loading level 10.

A control device 12 optionally provided in the body or in the door 3 of the dishwasher 1 is configured among other things to control the sequence of wash programs for washing items to be washed. The control device 12 can also actuate other controllable units 14, 15, 16 (see FIG. 2).

The dishwasher 1 shown in FIG. 1 further comprises a detector 13 which is configured to detect the presence of a living being and/or object in at least one defined area. The detector 13 can output the result of a measurement to the control device 12 by means of a detection signal DS (see FIG. 2). By a measurement is understood that the detector 13 checks whether a living being and/or an object are/is located in the at least one defined area. Alternatively, the control device 12 can activate the detector 13 in such a way that the latter performs a measurement and outputs a corresponding detection signal DS (see FIG. 2) to the control device 12.

Figure 2:
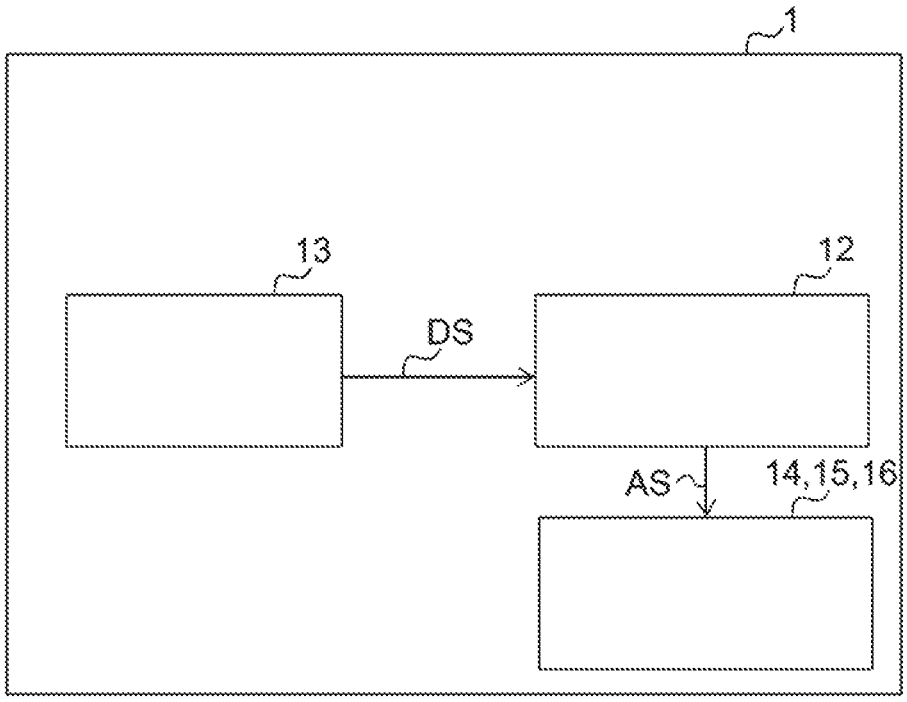
FIG. 2 shows a schematic block diagram of a second embodiment of a water-conducting domestic appliance.

In addition, the dishwasher 1 of FIG. 1 comprises at least one further controllable unit 14, 15, 16 (see FIG. 2). The at least one further controllable unit 15 is in particular a door opening module 14 and/or a user interface 16. A further controllable unit may be e.g. a pump controller for actuating a pump of the dishwasher.

The dishwasher 1 may be for example a free-standing, an integrated or a fully integrated dishwasher 1.

The detector 13 may comprise for example a motion sensor, an infrared motion sensor, an HF sensor, an ultrasound sensor, a Doppler radar sensor and/or an image recognition device.

FIG. 2 shows a schematic block diagram of a second embodiment of a water-conducting domestic appliance 1. In the example shown in FIG. 2, the control device 12 receives a detection signal DS from the detector 13 and by outputting at least one control signal AS activates at least one further controllable unit 15. The controllable unit 15 may comprise in particular a door opening module 14 or a user interface 16.

Figure 3:
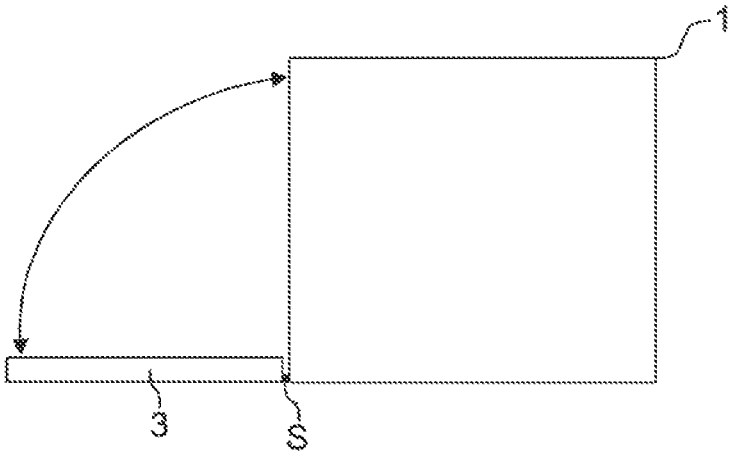
FIG. 3 shows a side view of a third embodiment of a water-conducting domestic appliance.

FIG. 3 shows a side view of a further embodiment of a water-conducting domestic appliance 1. In the example illustrated in FIG. 3, a dishwasher 1 is shown, the dishwasher 1 being depicted with an open door 3. When the door 3 is opened, it is pivoted about the axis of rotation S, and for that purpose requires a spatial volume determined by the movement radius of the door 3, which is represented schematically in FIG. 3. The detector 13 is configured in particular to detect a living being and/or object located in said movement radius.

Figure 4:
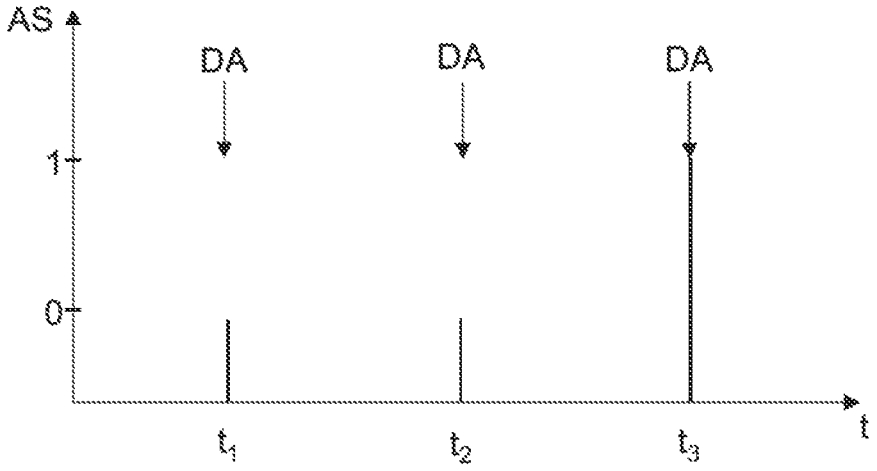
FIG. 4 shows a schematic timing diagram for an example of the sequence of a plurality of detection and control processes.

FIG. 4 shows a schematic timing diagram as an example of the sequence of a plurality of detection and control processes performed by the detector 13 and the control device 12. In this case, following each detection query DA at the time instants $t_i$, where a specific period of time $\Delta t$ lies between two succeeding time instants $t_i$, $t_{i+1}$, a control signal AS is output by the control device 12 as a function of a detection signal DS of the detector 13.

In the example shown in FIG. 4, the control signal AS comprises two values (0 or 1), where "0" means that the door opening module 14 is actuated in such a way that an opening of the door is prevented. After the specific period of time $\Delta t$ has elapsed, a new detection query DA of the detector 13 is therefore performed by the control device 12, and once again a corresponding control signal AS is output. Upon the third detection query DA at the time instant $t_3$, a "1" is output, which in this example means that the door opening module 14 can open the door 3 automatically. The iterative loop is thus interrupted.

More complex control signals AS, e.g. an arbitrary finite sequence of "0" or "1", are also possible, thereby also enabling further controllable units 15, 16 to be actuated or more complex control processes to be performed.

Figure 5:
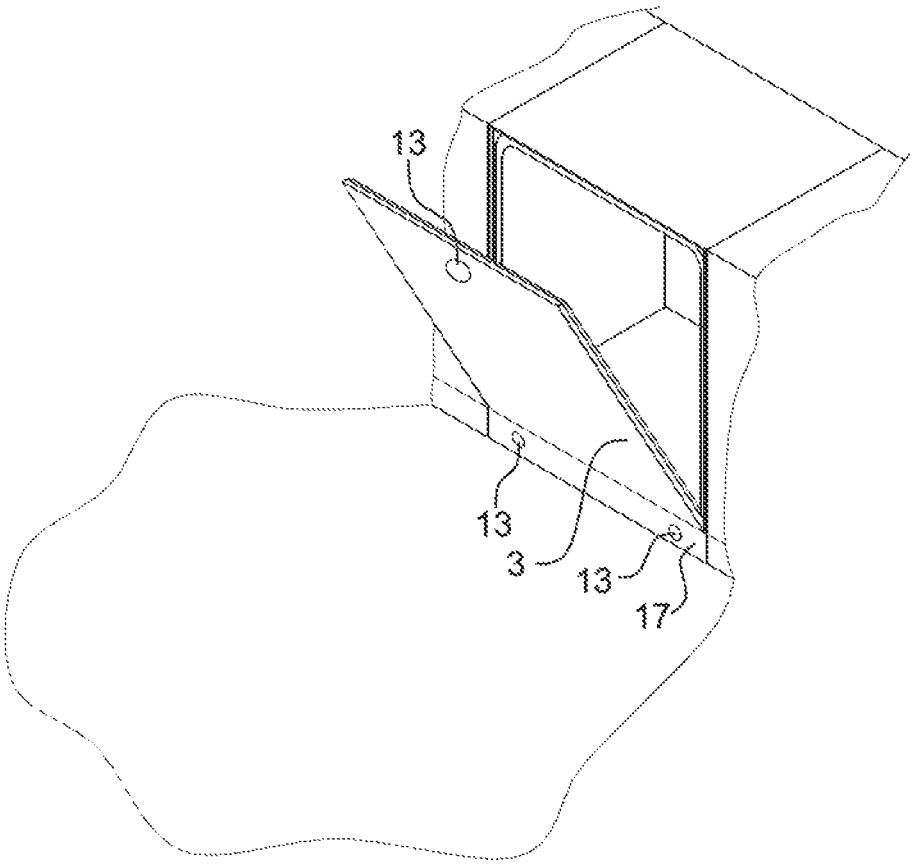
FIG. 5 shows a perspective view of a fourth embodiment of a water-conducting domestic appliance.

FIG. 5 shows a perspective front view of a further embodiment of a water-conducting domestic appliance 1. In the example shown in FIG. 5, the domestic appliance 1 is represented as a dishwasher, the dishwasher 1 being depicted with the door 3 partially open. Detectors 13 are installed in the upper section of the door 3 as well as in the plinth 17.

The detectors 13 may fulfill different functions. Thus, for example, the detectors 13 installed in the plinth 17 may be activated only when the door 3 is fully open in order to initiate an automatic closing of the door 3 upon detection of a user gesture (e.g. with the foot).

Figure 6:
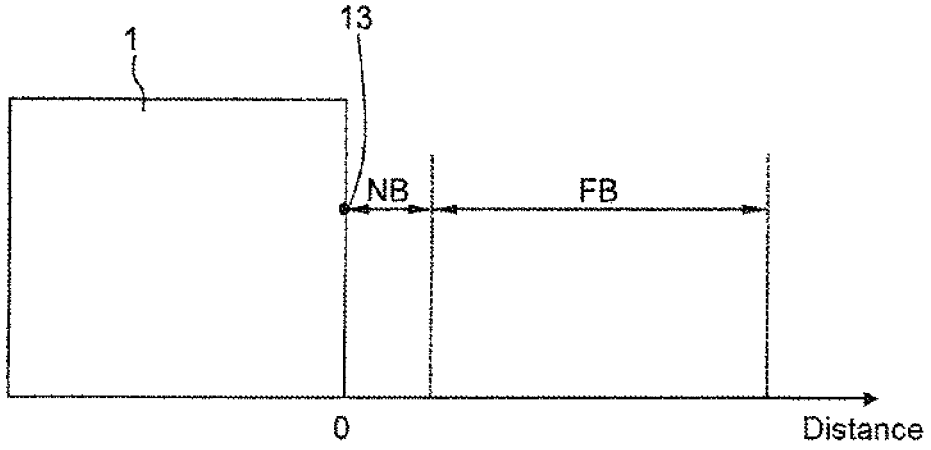
FIG. 6 shows a schematic illustrating an arrangement of different detection zones.

FIG. 6 shows a side view of a further embodiment of a water-conducting domestic appliance 1, wherein likewise different detection zones NB, FB are illustrated. In the example shown in FIG. 6, the detector 13 distinguishes between the following two detection zones: a near zone NB and a remote zone FB. In this case the detector 13 is configured to output a first detection signal DS as a function of the detection of a living being and/or an object in the near zone NB, and to output a second detection signal DS as a function of the detection of a living being and/or an object in the remote zone FB.

In particular, the detector 13 may be suitable for detecting a user gesture in the near zone NB and outputting a corresponding detection signal DS which is recognized by the control device 12, which initiates a specific function, e.g. an automatic opening of the door 3 of the domestic appliance 1, by way of a control signal AS.

It is also possible for more than two detection zones to be defined. In such a case the detector 13 is configured to identify the presence of a living being and/or an object in each of the more than two defined detection zones and as a function thereof to output one of a corresponding plurality of detection signals DS.

Figure 7:
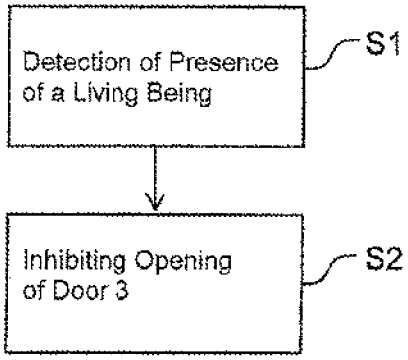
FIG. 7 shows an exemplary embodiment of a method for operating the water-conducting domestic appliance.

FIG. 7 shows an exemplary embodiment of a method for operating a water-conducting domestic appliance 1. The water-conducting domestic appliance 1 is embodied for example according to one of FIG. 1, 3, 5 or 6 and comprises a control device 12 for controlling various functions of the domestic appliance 1, as well as a detector 13 for detecting a living being and/or an object in at least one defined area, wherein the detector 13 can output a detection signal DS to the control device 12. In addition, the domestic appliance 1 comprises at least one further controllable unit 15, which may be in particular a door opening module 14 and/or a user interface 16.

In step S1, a presence of a living being is detected in a defined area in front of the domestic appliance 1.

In step S2, an opening of the door 3 is prevented as a function of a detected presence of a living being in the defined area in front of the domestic appliance 1.

Although the present invention has been described with reference to exemplary embodiments, it lends itself to a wide variety of modifications.

What is claimed is:

1. A water-conducting domestic appliance, comprising:

a washing container;

a door pivotably mounted to the washing container to define with the washing container a washing chamber for washing items;

a detector configured to detect a presence of a living being in a defined area in front of the domestic appliance and within an entire movement radius of the pivotably mounted door;

a door opening module configured to automatically open the door to a desired gap during a drying process in order to ventilate the washing chamber to assist in drying of washed items; and a control device configured to permit automatic opening of the door by the door opening module to the desired gap during the drying process in order to ventilate the washing chamber on condition that the presence of a living being is not detected in the defined area and configured to inhibit automatic opening of the door by the door opening module in response to the detection of a living being in the defined area.

2. The domestic appliance of claim 1, constructed in the form of a dishwasher.

3. The domestic appliance of claim 1, wherein the detector comprises at least one member selected from the group consisting of a motion sensor, an infrared motion sensor, an HF sensor, an ultrasound sensor, a Doppler radar sensor, and an image recognition device.

4. The domestic appliance of claim 1, wherein the control device is configured to prevent opening of the door for a specific period of time when the presence of a living being has been detected in the defined area.

5. The domestic appliance of claim 4, wherein the control device is configured to again check, after elapse of the specific period of time, whether the detector has detected the presence of a living being in the defined area and, if affirmative, to prevent opening of the door and/or to execute an alternative control function.

6. The domestic appliance of claim 1, wherein the detector is placed in one of four ways, a first way in which the detector is mounted on the door, a second way in which the detector is integrated in a door leaf of the door, a third way in which arranged the detector is in a plinth of the domestic appliance, a fourth way in which the detector is integrated in a control panel of the door.

7. The domestic appliance of claim 1, wherein the control device is configured to generate a control signal for actuating at least one specific unit when the presence of a living being has been detected in the defined area.

8. The domestic appliance of claim 7, wherein the at least one specific unit is at least one member selected from the group consisting of a lighting device for illuminating the washing container, a projection device for projecting a remaining operating time of the domestic appliance, a display lighting of a display of the domestic appliance, an output device for outputting at least one acoustic signal, a web-based application function, and an actuation device for activating a pump of the domestic appliance.

9. The domestic appliance of claim 1, wherein the detector is an HF sensor configured to detect a blockage of a spray arm in the washing container.

10. The domestic appliance of claim 9, wherein the control device is configured to activate a user interface to output a user output to warn a user, when the HF sensor has detected the blockage of the spray arm.

11. The domestic appliance of claim 1, wherein the detector is configured to provide a first detection signal, when the presence of a living being has been detected in a remote zone of the domestic appliance, and to provide a second detection signal, when the presence of a living being has been detected in a near zone of the domestic appliance.

12. The domestic appliance of claim 11, wherein the control device is configured to prevent opening of the door when the first detection signal has been provided, and to actuate the door opening module when the second detection signal has been provided so as to open the door automatically.

13. The domestic appliance of claim 1, further comprising a safeguard system configured to stop the door at the desired gap and thus prevent the door from dropping open in an uncontrolled manner.

14. A method for operating a water-conducting domestic appliance, comprising:

detecting a presence of a living being in a defined area in front of the domestic appliance and within an entire movement radius of a pivotably mounted door of the domestic appliance;

permitting automatic opening of the door of the domestic appliance by a door opening module to a desired gap during a drying process in order to ventilate a washing chamber to assist in drying of washed items on condition that the presence of a living being is not detected in the defined area; and inhibiting automatic opening of the door of the domestic appliance in response to a detection of a living being in the defined area.

15. The method of claim 14, wherein the domestic appliance is a dishwasher.

16. A computer program embodied in a non-transitory computer readable medium, wherein the computer program, when loaded into a processing device and executed by the processing device, causes the processing device to perform a method for operating a water-conducting domestic appliance, the method comprising detecting a presence of a living being in a defined area in front of the domestic appliance and within an entire movement radius of a pivotably mounted door of the domestic appliance;

permitting automatic opening of the door of the domestic appliance by a door opening module to a desired gap during a drying process in order to ventilate a washing chamber to assist in drying of washed items on condition that the presence of a living being is not detected in the defined area; and inhibiting automatic opening of the door of the domestic appliance in response to a detection of a living being in the defined area.

* * * * *